US005954979A

United States Patent [19]

Counts et al.

[11] Patent Number: 5,954,979

[45] Date of Patent: Sep. 21, 1999

[54] HEATER FIXTURE OF AN ELECTRICAL SMOKING SYSTEM

[75] Inventors: Mary Ellen Counts; William J. Crowe, both of Richmond; John L. Felter, Chester; Grier S. Fleischhauer, Midlothian; Mohammad R. Hajaligol, Richmond; Patrick H. Hayes, Chester; Willie G. Houck; H. Neal Nunnally, both of Richmond, all of Va.

[73] Assignee: Philip Morris Incorporated, New York, N.Y.

[21] Appl. No.: 08/951,225

[22] Filed: Oct. 16, 1997

[51] Int. Cl.[6] ..... F23Q 7/00

[52] U.S. Cl. ..... 219/260; 219/535; 219/539; 338/310; 131/194; 131/329

[58] Field of Search ..... 219/260, 263, 219/535, 537, 539; 338/310; 392/485, 488, 489, 492, 493; 128/202.21, 203.27; 131/94, 182, 194, 273, 329

[56] References Cited

U.S. PATENT DOCUMENTS

| | | | |
|---|---|---|---|
| 4,638,820 | 1/1987 | Roberts et al. | 131/336 |
| 4,898,190 | 2/1990 | Deal | 131/336 |
| 4,949,736 | 8/1990 | Roberts et al. | 131/336 |
| 5,144,962 | 9/1992 | Counts et al. | 131/194 |
| 5,388,594 | 2/1995 | Counts et al. | 131/329 |
| 5,505,214 | 4/1996 | Collins et al. | 131/194 |
| 5,591,368 | 1/1997 | Fleischhauer et al. | 219/535 |
| 5,665,262 | 9/1997 | Hajaligol et al. | 219/553 |

*Primary Examiner*—Teresa Walberg
*Assistant Examiner*—Vinod D. Patel
*Attorney, Agent, or Firm*—Charles E.B. Glenn; Kevin B. Osborne; James T. Moore

[57] ABSTRACT

A novel electrical smoking system and method of establishing resistance to draw upon a cigarette while smoking a cigarette in an electrical smoking system comprising the step of operatively interposing a frit between a source of ambient air and the cigarette.

33 Claims, 13 Drawing Sheets

HEATER FIXTURE OF AN ELECTRICAL SMOKING SYSTEM

FIELD OF INVENTION

This invention relates to electrically powered smoking systems, and more particularly to heater elements of electrically powered smoking systems.

BACKGROUND OF THE INVENTION

Commonly assigned, U.S. Pat. Nos. 5,388,594, 5,505,214, and 5,591,368 disclose various electrically powered smoking systems comprising electric lighters and cigarettes. The systems provide smoking pleasure while significantly reducing sidestream smoke and permitting the smoker to selectively suspend and reinitiate smoking.

The preferred embodiment of the lighter in U.S. Pat. No. 5,388,594 includes a plurality of metallic serpentine heaters disposed in a configuration that slidingly receives a tobacco rod portion of the system's cigarette. The cigarette and the lighter are configured such that when the cigarette is inserted into the lighter and as individual heaters are activated for each puff, localized charring occurs at spots about the cigarette in the locality where each heater bears against the cigarette (hereinafter referred to as a "heater footprint").

In U. S. Pat. No. 5,388,594, the sequence and the amount of energy applied to each heater element during a puff cycle is regulated by a logic circuit of a controller which executes a power subroutine upon its receiving a signal from a puff sensor. The power subroutine includes the steps of reading the voltage of the power source (batteries) at the initiation of the puff and resolving a shut-off signal in cooperation with a constant Joules energy timer such that the duration of the pulse (its cycle-period) is adjusted relative to the voltage of the power source to provide the same total amount of energy (Joules) throughout the range of voltages of the battery discharge cycle.

In U.S. Pat. No. 5,388,594, air is admitted into the interior of the heater fixture of its lighter through one or more intake ports formed at or about the seal between the cigarette and the cigarette-receiving opening of the lighter. In the alternative or in conjunction, additional ports are provided along one or more sides of the lighter housing. The air is drawn to along the cigarette.

It has been discovered in the air management system disclosed in U.S. Pat. No. 5,388,594, the ports tended to be very small if they were sized so as to create a resistance to draw commonly experienced in smoking a more traditional cigarette for a standard airflow rate of, for example, 1050 cubic centimeters per minute (cc/min). Their tiny size would necessitate precise machining in the manufacture of the lighter housing, adding expense and reducing the range of acceptable margins for error. Machining the correct diameter is exacting, because any error in diameter has a second order relation with cross-sectional area, and the latter is a determinative factor upon resistance to draw through an orifice. Accordingly, a small variation in the diameter of the intake ports can create unacceptable variations in resistance to draw in electrical lighter systems The minute size of the ports also tended to localize or "jet" the air into the interior of the heater fixture, sometimes creating a whistling noise to the distraction of the smoker. The localization of airflow would allow some parts of the heater fixture to receive more air than others, which situation could compromise uniformity amongst consecutive executions of puff cycles.

Additionally, the dynamic range and character of drawing air through tiny ports differed from that experienced with a more traditional filter cigarette. Typically, an air intake system of an electrical lighter could be configured to approximate the resistance to draw of a more traditional filtered (lit) cigarette at a preselected (design point) draw rate; but the two systems would respond differently as a smoker would progress through a puff, which typically involves a ramping up and then down in draw rate. In comparison to the more traditional cigarettes, the prior electric lighter designs tended to create more and more excess pressure drop (resistance to draw) as a puff would progress through the higher levels of draw rate.

In U.S. Pat. No. 4,947,874 to Brooks et al, a smoking article includes a singular electrical resistance heating element that is impregnated with aerosol forming material and heated in a succession of power cycles. The article includes a current regulating circuit which provides an uninterrupted current flow immediately upon draw for about 1.5 to about 2 seconds followed by an "off" period of about 0.5 to about 1 second. The patent also proposes an alternative to an on-off time-based circuit, which alterative would include on-off and current modulating means connected to temperature sensors or other sensors that would sense either the temperature of the heating element directly or the temperature of air passing the heating element or the temperature of a second resistor having a character related to that of the aerosol carrying heating element.

The article disclosed in U.S. Pat. No. 4,947,874 is disadvantaged by its repetitively heating a singular heater and the material impregnated thereon, which creates a situation of already depleted tobacco material being heated again and again.

OBJECTS AND SUMMARY OF INVENTION

A central object of the present invention is to provide a heater fixture within an electrical cigarette system wherein the dynamic response in resistance to draw during a puff is similar to that of a more traditional filter cigarette.

Another object of the present invention is to provide an electrical cigarette lighter which delivers consistent smoke from puff to puff throughout the smoking of a cigarette.

Yet another object of the present invention is to provide an air management arrangement in a lighter of an electrical smoking system that admits air into the system with a resistance-to-draw verses flow rate characteristic similar to that of a more traditional cigarette.

Another object of the present invention is to provide a lighter fixture having an air admission system that facilitates manufacture yet provides precise duplication of drawing characteristics in each lighter consistently from lighter to lighter.

Still another object is to provide a heater fixture of an electrical smoking system which provides a uniform distribution of air about the cigarette.

Yet another object of the present invention is to provide such a heater fixture that introduces air to the tobacco rod portion of the cigarette in the same general direction as smoke is withdrawn from the tipped end of cigarette.

Yet another object is to provide a heater that overcomes differences between the first draw and other subsequent puffs in an electrical smoking system.

These and other objects are achieved by the present invention, which provides a heater fixture within a lighter of an electrical smoking system having an improved an air management system. The heater fixture includes a cigarette receiver; a passageway for communicating a selected location along the cigarette receiver with a source of air; and a frit at a location along the passageway, whereby the frit is configured and sized to achieve desired airflow characteristics including total flow rate and resistance to draw. A porting ring, located preferably downstream of the frit, is configured so as to achieve desired flow distribution about the cigarette receiver.

Another aspect of the present invention is the configuration of placing a frit adjacent to an air intake manifold and placing orifices downstream of the frit, such that the frit controls that amount of air admitted into the heater fixture, while the orifices circumferentially distribute and axially direct the admitted air toward a base portion of the fixture.

Still another aspect of the present invention include features which direct the airflow within the lighter such that the air first approaches the tobacco rod portion of the cigarette in the same direction as smoke is withdrawn from the cigarette so as to minimize air turbulence and condensates within the heater fixture.

BRIEF DESCRIPTION OF THE DRAWING

These and other objects, advantages and novel features of the present invention will become apparent from the following detailed description of the preferred embodiments of the present invention when considered in conjunction with the accompanying drawing, in which.

DETAILED DESCRIPTION OF THE PREFERRED EMBODIMENTS

Figure 1:
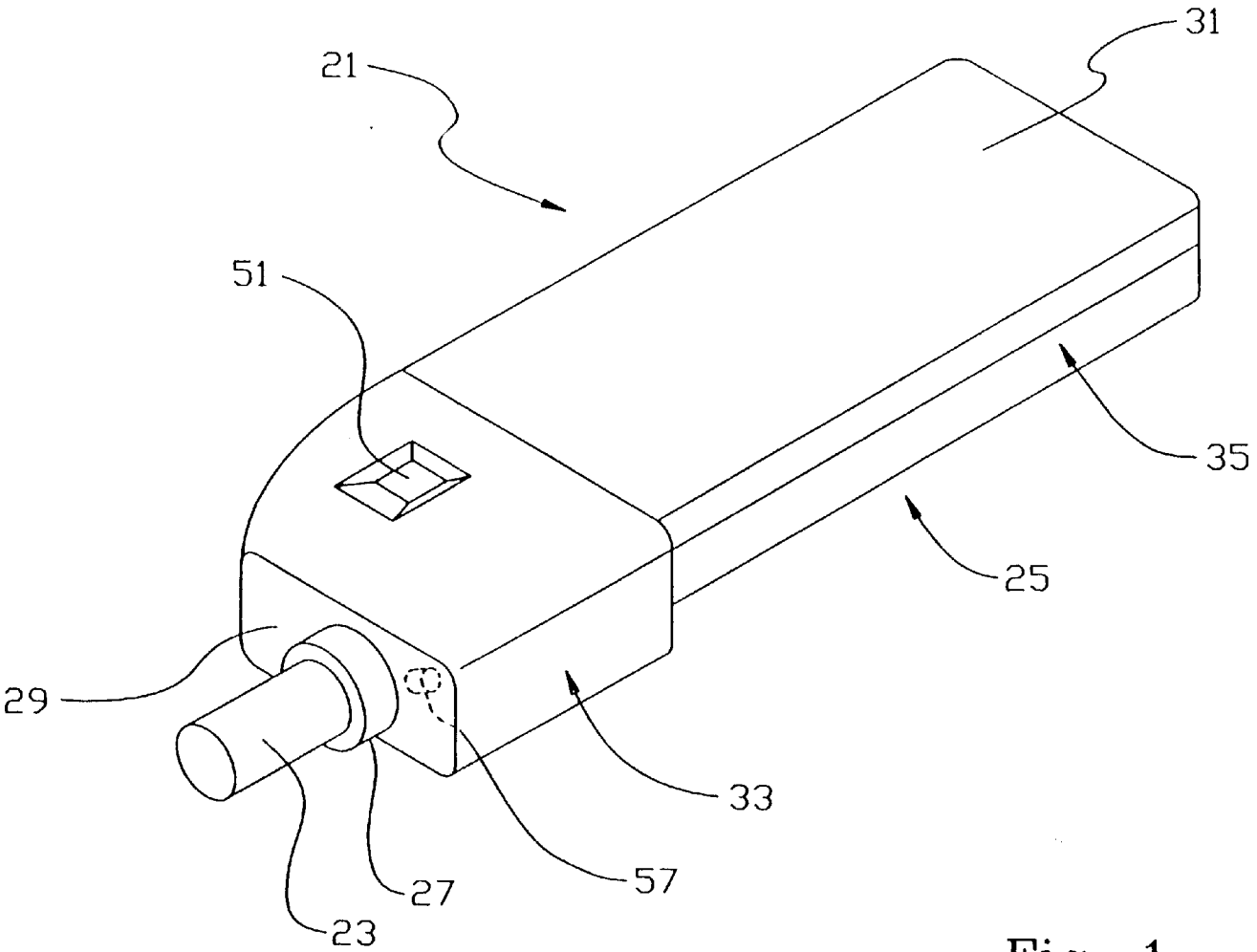
FIG. 1 is a perspective view of a smoking system in accordance with a preferred embodiment of the present invention with a cigarette of the system inserted into the electrically operated lighter.
Figure 2:
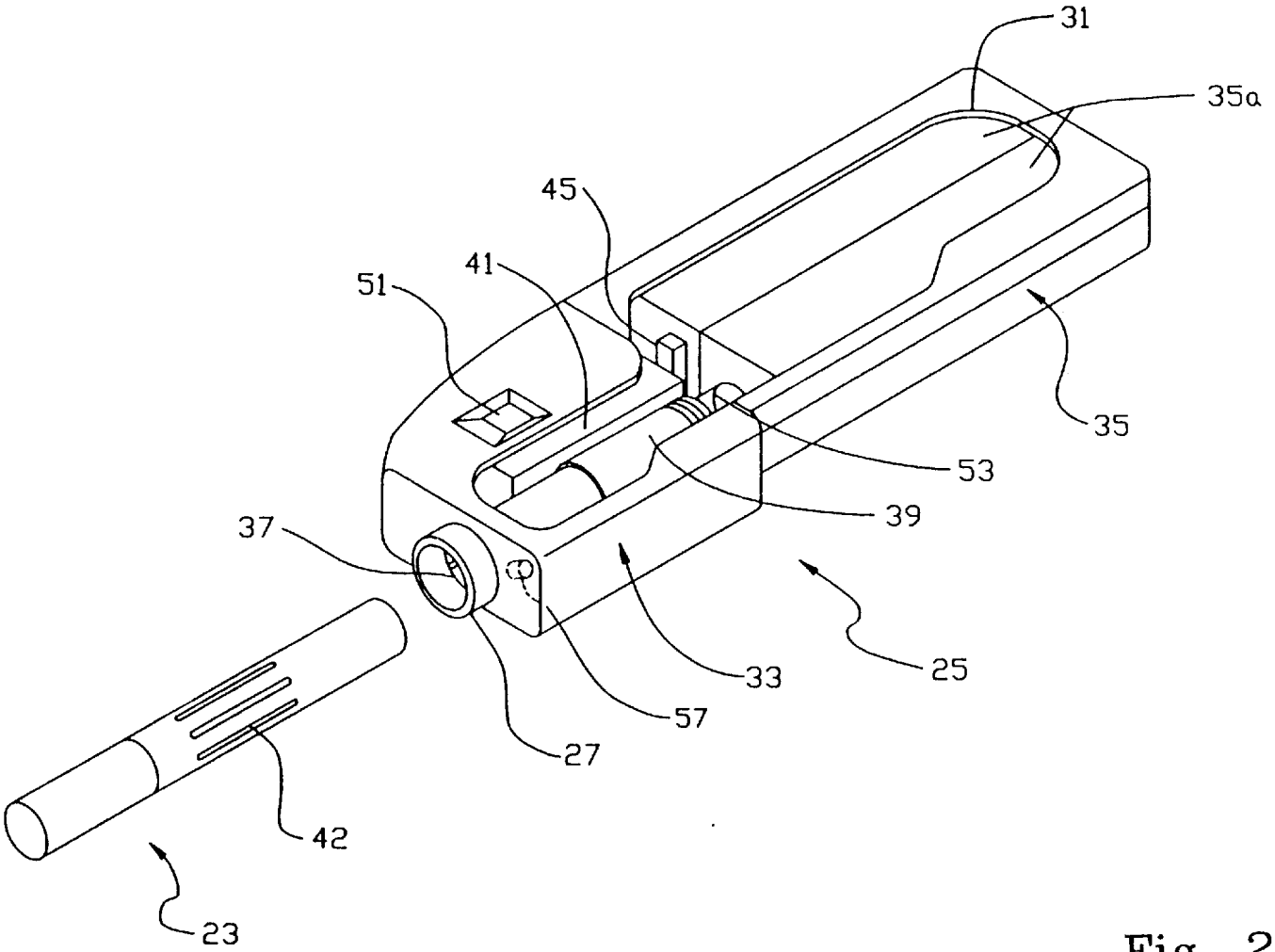
FIG. 2 is a perspective view of the smoking system of FIG. 1, but with the cigarette withdrawn from the lighter upon conclusion of a smoking.

Referring to FIGS. 1 and 2, a preferred embodiment of the present invention provides a smoking system 21 which preferably includes a partially-filled, filter cigarette 23 and a reusable lighter 25. The cigarette 23 is adapted to be inserted into and removed from a cigarette receiver 27 which is open at a front end portion 29 of the lighter 25. Once the cigarette 23 is inserted, the smoking system 21 is used in much the same fashion as a more traditional cigarette, but without lighting or smoldering of the cigarette 23. The cigarette 23 is discarded after one or more puff cycles. Preferably, each cigarette 23 provides a total of eight puffs (puff cycles) or more per smoke; however it is a matter of design expedient to adjust to a lesser or greater total number of available puffs.

Further particulars of the smoking system is described also in the commonly assigned, U.S. Pat. Nos. 5,388,594; 5,505,214; 5,591,368 and 5,499,636, all which are hereby incorporated by reference in their entireties.

The lighter 25 includes a housing 31 having front and rear housing portions 33 and 35. One or more batteries 35*a* are removably located within the rear housing portion 35 and supply energy to a heater fixture 39 which includes a plurality of electrically resistive, heating elements 37 (shown in FIGS. 3A–C). The heating elements 37 are arranged within the front housing portion 33 to slidingly receive the cigarette 23 along an intermediate portion of the cigarette receiver 27. A stop 182 located at the base of the heater fixture 39 defines a terminus of the cigarette receiver 27.

A control circuit 41 in the front housing portion 33 selectively establishes electrical communication between the batteries 35*a* and one or more the heater elements 37 during execution of each puff cycle. The preferred embodiment of the present invention includes details concerning an air management system for effecting the admission and routing of air within the lighter, including aspects which are discussed in greater detail beginning with reference to FIG. 6.

Still referring to FIGS. 1 and 2, preferably the rear portion 35 of the lighter housing 31 is adapted to be readily opened and closed, such as with screws or snap-fit components, so as to facilitate replacement of the batteries. If desired, an electrical socket or contacts may be provided for recharging the batteries in a charger supplied with house current or the like. Preferably, the front housing portion 33 is removably joined to the rear housing portion 35, such as with a dovetail joint or a socket fit.

The batteries 35*a* are sized to provide sufficient power for the heaters 37 to function as intended and preferably comprise a replaceable and rechargeable type. Alternate sources of power are suitable, such as capacitors. In the preferred embodiment, the power source comprises four nickel-cadmium battery cells connected in series with a total, non-loaded voltage in the range of approximately 4.8 to 5.6 volts. The characteristics of the power source are, however, selected in view of the characteristics of other components in the smoking system 21, particularly the characteristics of the heating elements 37. Commonly assigned U.S. Pat. No. 5,144,962, hereby incorporated by reference, describes several types of power sources useful in connection with the smoking system of the present invention, such as rechargeable battery sources and power arrangements which comprise a battery and a capacitor which is recharged by the battery.

Referring specifically to FIG. 2, preferably, the circuitry 41 is activated by a puff-actuated sensor 45 that is sensitive to either changes in pressure or changes in rate of air flow that occur upon initiation of a draw on the cigarette 23 by a smoker. The puff-actuated sensor 45 is preferably located within the front housing portion 33 of the lighter 25 and is communicated with a space inside the heater fixture 39 adjacent the cigarette 23 via a port extending through a stop 182 located at the base of the heater fixture 39. A puff-actuated sensor 45 suitable for use in the smoking system 21 is described in commonly assigned U.S. Pat. No. 5,060,671 and U.S. Pat. No. 5,388,594, the disclosures of which are incorporated herein by reference.

The puff sensor 45 preferably comprises a Model 163PCO1D35 silicon sensor, manufactured by the MicroSwitch division of Honeywell, Inc., Freeport, Ill. Flow sensing devices, such as those using hot-wire anemometry principles, have also been successfully demonstrated to be useful for actuating an appropriate one of the heater elements 37 upon detection of a change in air flow. Once actuated by the sensor 45, the control circuitry 41 directs electric current to an appropriate one of the heater elements 37.

An indicator 51 is provided at a location along the exterior of the lighter 25, preferably on the front housing portion 33, to indicate the number of puffs remaining in a smoke of a cigarette 23. The indicator 51 preferably includes a seven-segment liquid crystal display. In the preferred embodiment, the indicator 51 displays the digit "8" when a cigarette detector 57 detects the presence of a cigarette in the heater fixture 39. The detector 57 preferably comprises a light sensor adjacent the cigarette receiver 27 of the heater fixture 39 that generates a signal when a beam of light is reflected off an inserted cigarette 23 or when transmission of the beam across the cigarette receiver 27 is interrupted either wholly or partially. Thereupon the cigarette detector 57 provides a signal to the circuitry 41 which, in turn, responsively provides a signal to the indicator 51. The display of the digit "8" on the indicator 51 reflects that the eight puffs provided on each cigarette 23 are available, i.e., no puff cycle has been undertaken and none of the heater elements 37 have been activated to heat the cigarette 23. After the cigarette 23 is fully smoked, the indicator displays the digit "0". When the cigarette 23 is removed from the lighter 25, the cigarette detector 57 no longer detects a presence of a cigarette 23 and the indicator 51 is turned off.

The cigarette detector 57 is modulated so that it does not constantly emit a beam of light, which would otherwise create an unnecessary drain on the power source 35*a*. A preferred cigarette detector 57 suitable for use with the smoking system 21 is a Type OPR5005 Light Sensor, manufactured by OPTEX Technology, Inc., 1215 West Crosby Road, Carrollton, Tex. 75006.

In the alternative to displaying the remainder of the puff count, the detector display may instead be arranged to indicate whether the system is active or inactive ("on" or "off").

As one of several possible alternatives to using the above-noted cigarette detector 57, a mechanical switch (not shown) may be provided to detect the presence or absence of a cigarette 23 and a reset button (not shown) may be provided for resetting the circuitry 41 when a new cigarette is inserted into the lighter 25, e.g., to cause the indicator 51 to display the digit "8", etc. Power sources, circuitry, puff-actuated sensors, and indicators useful with the smoking system 21 of the present invention are described in commonly assigned, U.S. Pat. Nos. 5,060,671; 5,388,594 and 5,591,368, all which are incorporated herein by reference.

Figure 3A:
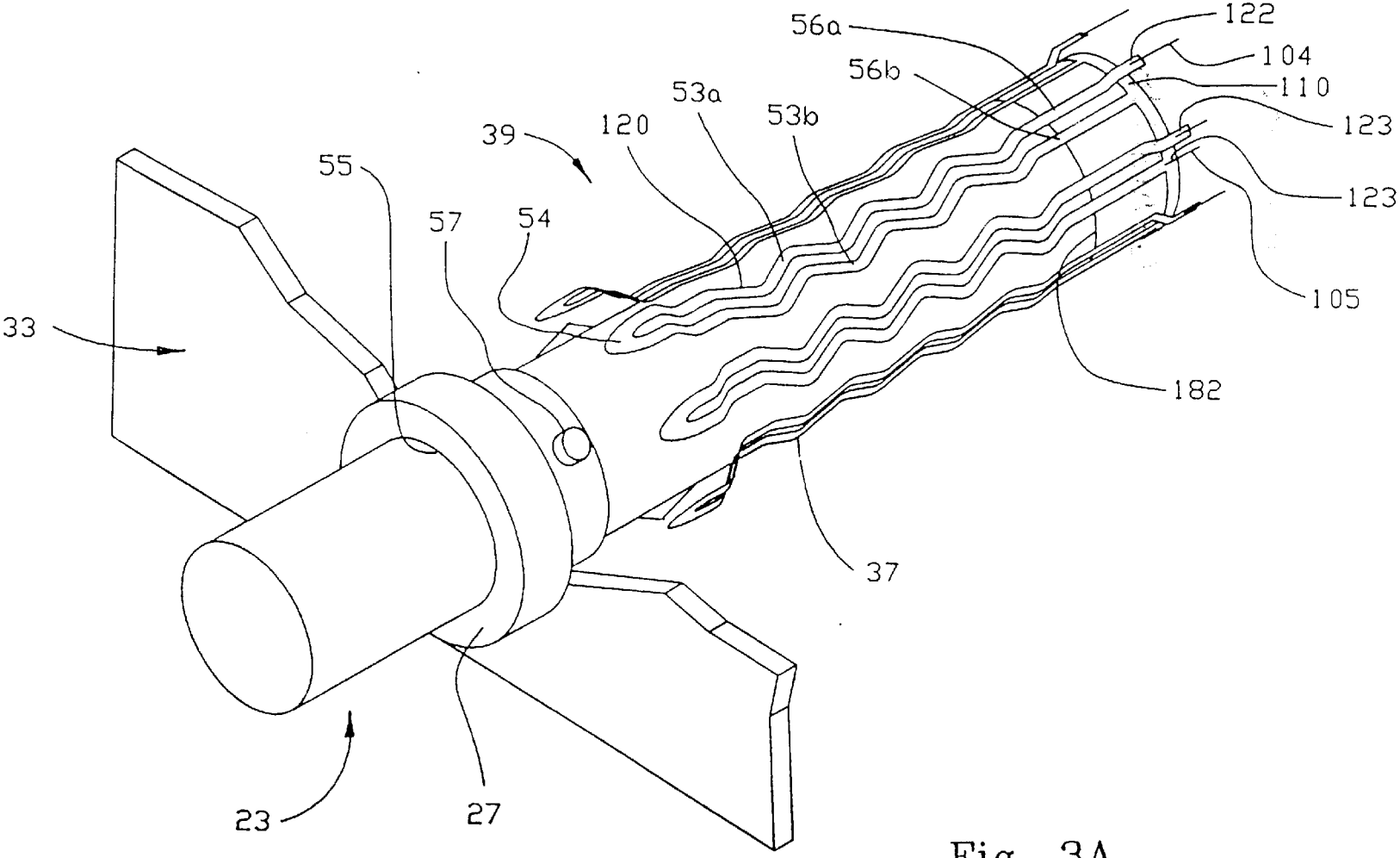
FIG. 3A is a partial perspective detail view of a preferred embodiment of the heater fixture of FIG. 1, including wavy hairpin heater elements and portions of a preferred air admission system.

Referring now to FIG. 3A, the front housing portion 33 of the lighter 25 encloses a substantially cylindrical heater fixture 39 whose heater elements slidingly receive the cigarette 23. The heater fixture 39 is adapted to support an inserted cigarette 23 in a fixed relation to the heater elements 37 such that the heater elements 37 are positioned alongside the cigarette 23 at approximately the same location along each newly inserted cigarette 23. In the preferred embodiment, the heater fixture 39 includes eight mutually parallel heater elements 37 which are disposed concentrically about the axis of symmetry of the cigarette receiver 27. The locations where each heater element 37 bears against (or is in thermal communication with) a fully inserted cigarette 23 is referred to herein as the heater footprint.

To assure consistent placement of the heating elements 37 relative to each cigarette 23 from cigarette to cigarette, the heater fixture 39 is provided with a base portion 300 (shown in FIG. 6) having a stop 182 against which the cigarette 23 is urged during its insertion into the cigarette receiver 27 of the lighter 25. Other expedients for registering the cigarette 23 relative to the lighter 25 could be used instead.

Still referring to FIG. 3A, most preferably the heater elements 37 are of a design referred to herein as a wavy hairpin heater element 37, wherein each heater element 37 includes at least first and second serpentine, elongate members 53*a* and 53*b* which are adjoined at an end portion (tip) 54. The tips 54 are adjacent the opening 55 of the cigarette receiver 27. The opposite ends 56*a* and 56*b* of each heater element 37 are electrically connected to the opposite poles of the power source 35*a* as selectively established by the controller 41. More specifically, an electrical pathway through each heater fixture 37 is established, respectively, through a terminal pin 104, a connection 122 between the pin 104 and a free end portion 56*a* of one of the serpentine members 53*a*, through at least a portion of the tip 54 to the other serpentine member 53*b* and its end portion 56*b*. Preferably, an integrally formed, common connection ring 110 provides a common electrical connection amongst all the end portions 56*b* of the elongate member 53*b*. In the preferred embodiment, the ring 110 is connected to the positive terminal of the power source 35*a* (or common) through a connection 123 between the ring 110 and a pin 105. Further details of the construction and establishment of electrical connections in the heater fixture 39 are illustrated and described in the commonly assigned U.S. Pat. Nos. 5,060,671; 5,388,594 and 5,591,368, all which are incorporated herein by reference.

Figure 3B:
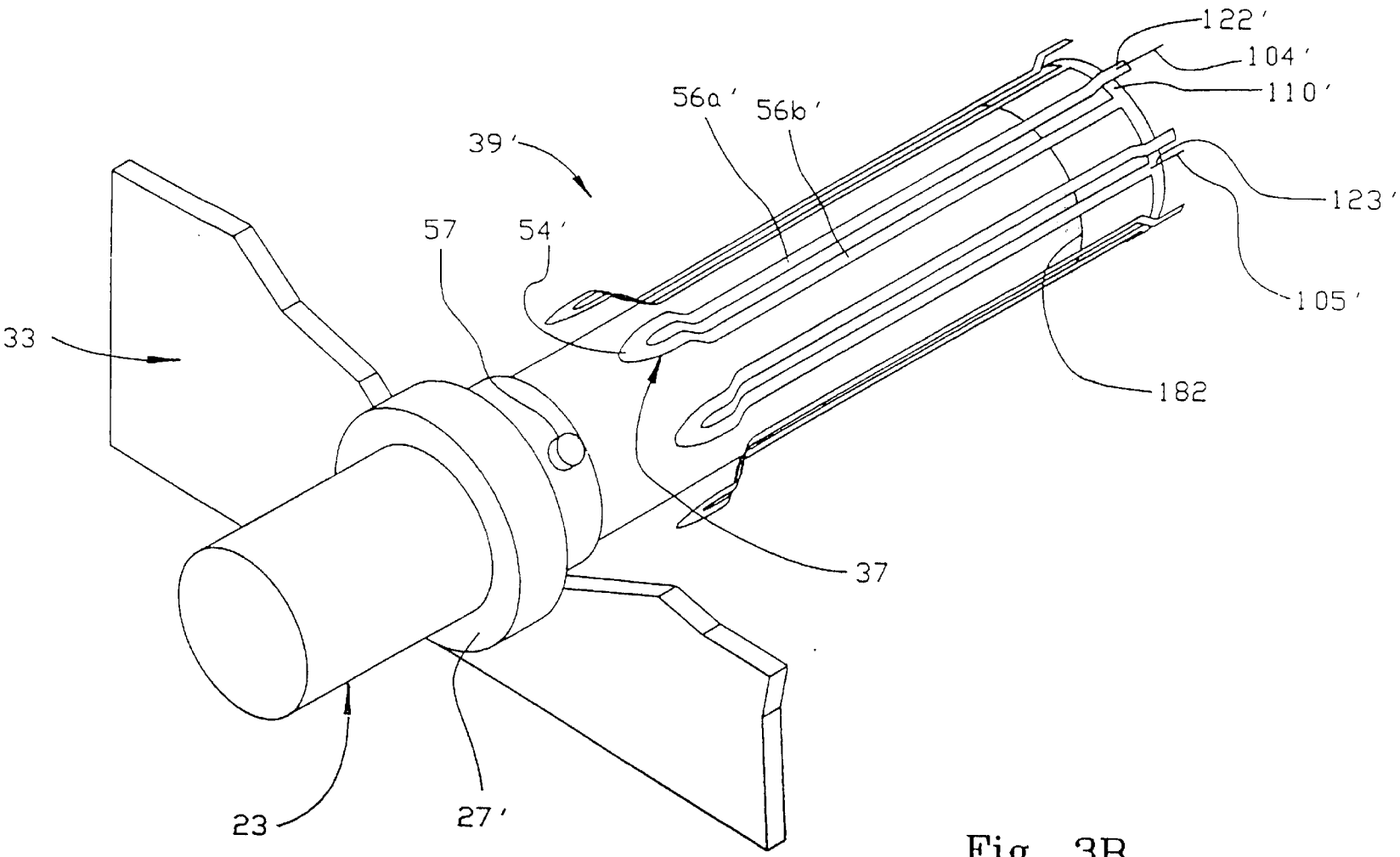
FIG. 3B is a partial perspective detail view of an alternate preferred embodiment of the heater fixture shown in FIG. 3A, including straight hairpin heater elements.

Referring now to FIG. 3B, another preferred design of the heater fixture 39' includes heater elements in the form of a straight hairpin heater elements 37', which are connected and structured similarly to the wavy hairpin element 37 of FIG. 3A, except that the elongate members 53*a*' and 53*b*' are generally straight instead of serpentine. The elongate members of both types of hairpin heaters 37 and 37' are preferably biased (bowed) inwardly to more positively engage a cigarette 23. Further details of this heater fixture 39' are set forth in the commonly assigned U.S. Pat. No. 5,591,368.

The heater portions 53*a*, 53*b* and 54 establish what is here referred to as a heater blade 120.

Figure 3C:
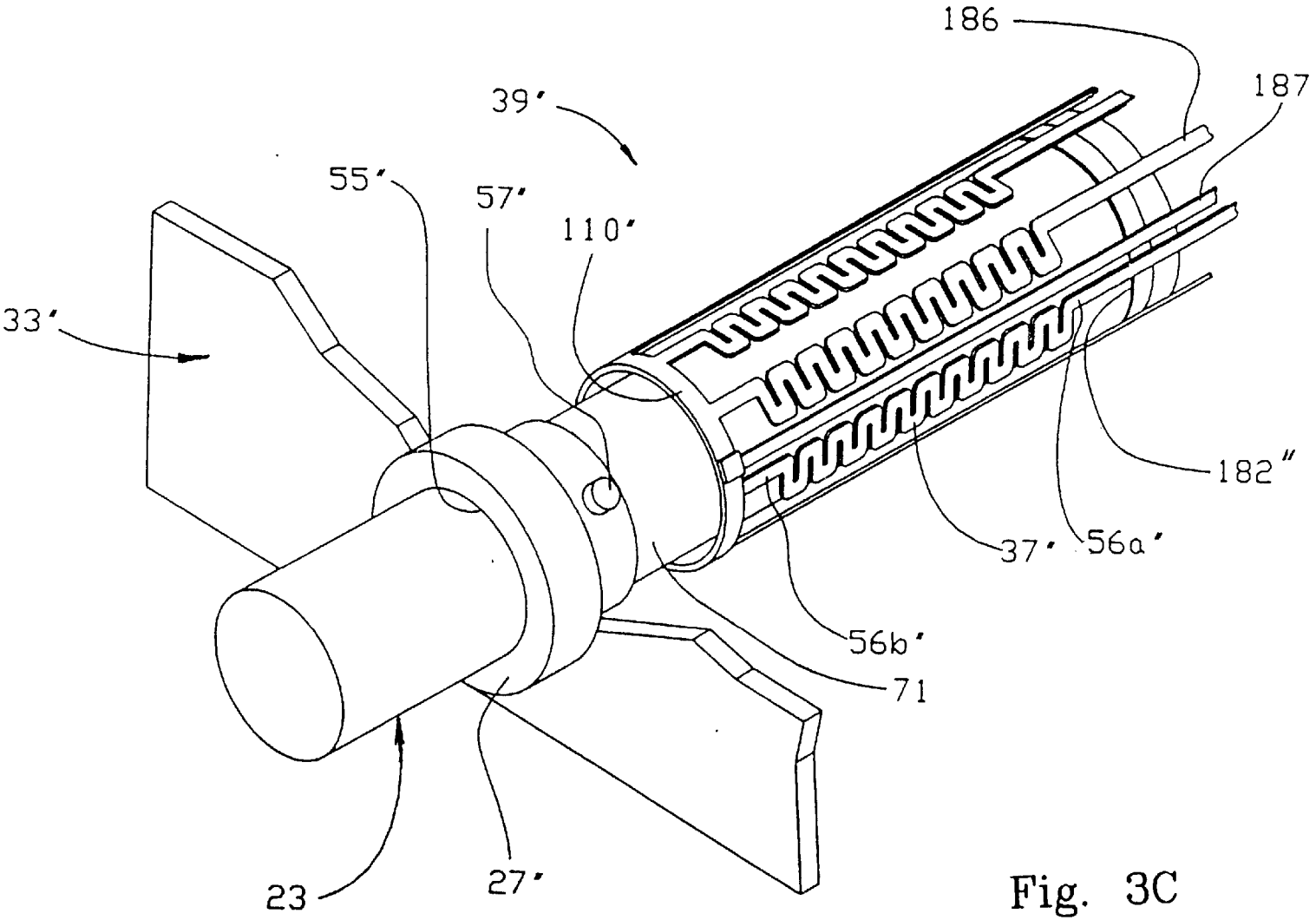
FIG. 3C is a partial perspective detail view of another alternate preferred embodiment of the heater fixture shown in FIG. 3A, including serpentine heater elements.

Referring now to FIG. 3C, yet another preferred heater fixture 39 includes "singular serpentine" heater elements 37", each which is electrically connected at its opposite ends to a control circuit 41 and power source 35*a* through leads 186 and 187. Electric lead 187 connects with a common connection ring 110" that is located adjacent the opening 55" of the cigarette receiver 27". Further details concerning this heater fixture 37" are set forth in commonly assigned U.S. Pat. No. 5,388,594, incorporated herein by reference in its entirety.

Additional heater fixtures 37 that are operable as part of the lighter 25 include those disclosed in commonly assigned, U. S. Pat. No. 5,665,262; and commonly assigned, U.S. Pat. No. 5,498,855, all which are incorporated herein by reference in their entireties.

Preferably, the heaters 37 are individually energized by the power source 35*a* under the control of the circuitry 41 to heat the cigarette 23 preferably eight times at spaced locations about the periphery of the cigarette 23. The heating renders eight puffs from the cigarette 23, as is commonly achieved with the smoking of a more traditional cigarette. It may be preferred to activate more than one heater simultaneously for one or more or all of the puffs.

Figure 4:
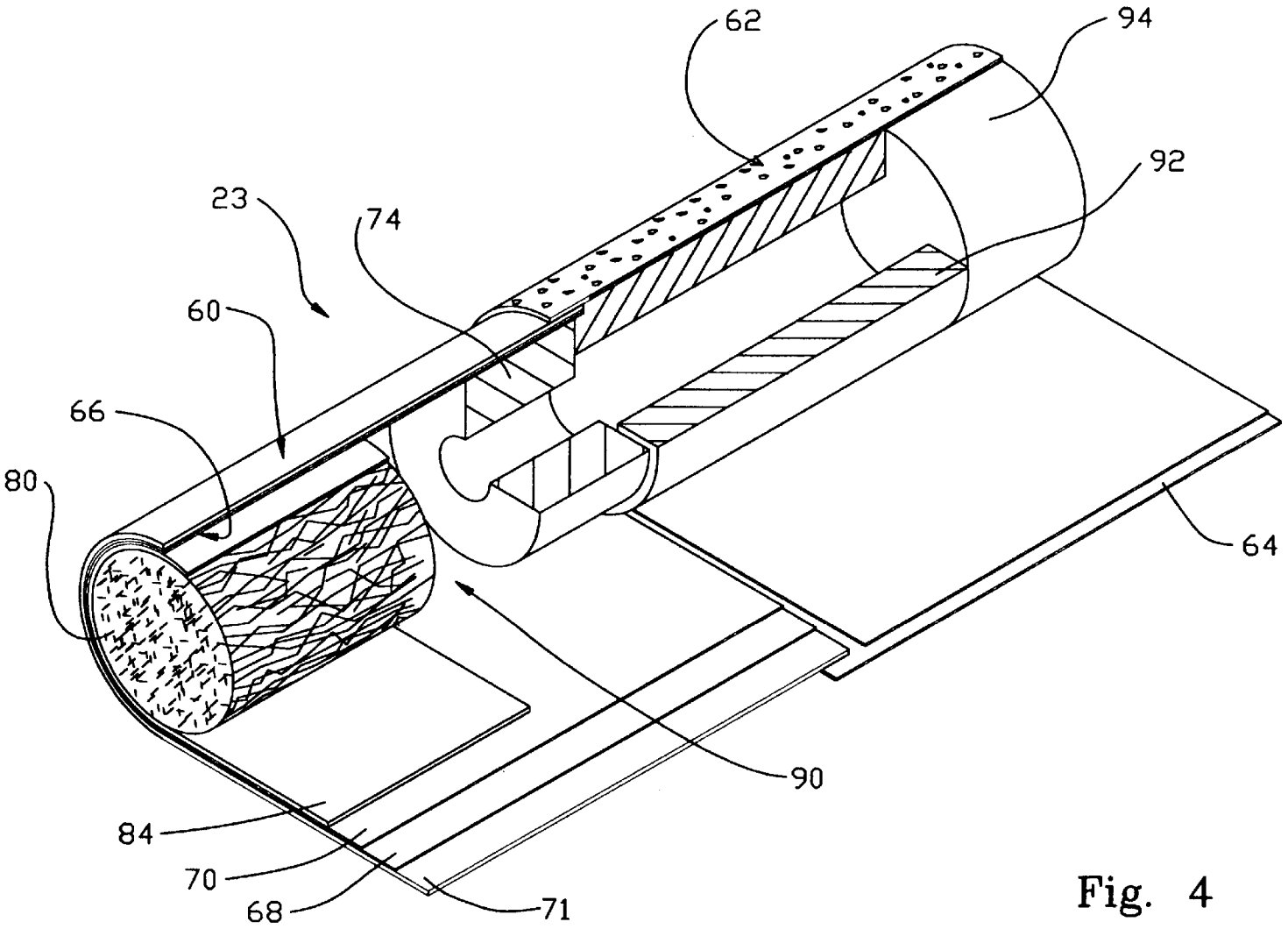
FIG. 4 is a detail perspective view of a preferred embodiment of the cigarette shown in FIG. 1, with certain components of the cigarette being partially unraveled.

Referring now to FIG. 4, the cigarette 23 is preferably constructed in accordance with the preferred embodiment set forth in commonly assigned, U.S. Pat. No. 5,499,636, herein incorporated by reference in its entirety.

The cigarette 23 comprises a tobacco rod 60 and a filter tipping 62, which are joined together with tipping paper 64.

The tobacco rod 60 of the cigarette 23 preferably includes a tobacco web 66 which has been folded into a tubular (cylindrical) form about a free-flow filter 74 at one of its ends and a tobacco plug 80 at the other. In the alternative, a plug of cellulose acetate might be used in place of the tobacco plug 80.

An overwrap 71 is intimately enwrapped about the tobacco web 66 and is held together along a longitudinal seam as is common in construction of more traditional cigarettes. The overwrap 71 retains the tobacco web 66 in a wrapped condition about a free-flow filter 74 and a tobacco plug 80.

The tobacco web 66 itself preferably comprises a base web 68 and a layer of tobacco flavor material 70 located along the inside surface of the base web 68. At the tipped end 72 of the tobacco rod 60, the tobacco web 66 together with the overwrap 71 are wrapped about the tubular free-flow filter plug 74. Preferably, the tobacco plug 80 is constructed separately from the tobacco web 66 and comprises a relatively short column of cut filler tobacco that preferably has been wrapped within and retained by a plug wrap 84.

As a general matter, the length of the tobacco plug 80 is preferably set relative to the total length of the tobacco rod 60 such that a void 90 is established along the tobacco rod 60 between the free-flow filter 74 and the tobacco plug 80. The void 90 corresponds to an unfilled portion of the tobacco rod 60 and is in immediate fluid communication with the tipping 62 through the free flow filter 74 of the tobacco rod 60.

The tipping 62 preferably comprises a free-flow filter 92 located adjacent the tobacco rod 60 and a mouthpiece filter plug 94 at the distal end of the tipping 62 from the tobacco rod 60. Preferably, the free-flow filter 92 is tubular and transmits air with very little pressure drop. Other low efficiency filters of standard configuration could be used instead, however. The inside diameter for the free flow filter 92 is preferably at or between 2 to 6 millimeters and is preferably greater than that of the free flow filter 74 of the tobacco rod 60.

The mouthpiece filter plug 94 closes off the free end of the tipping 62 for purposes of appearance and, if desired, to effect some filtration, although it is preferred that the mouthpiece filter plug 94 comprise a low efficiency filter of preferably about 15 to 25 percent efficiency.

Figure 5:
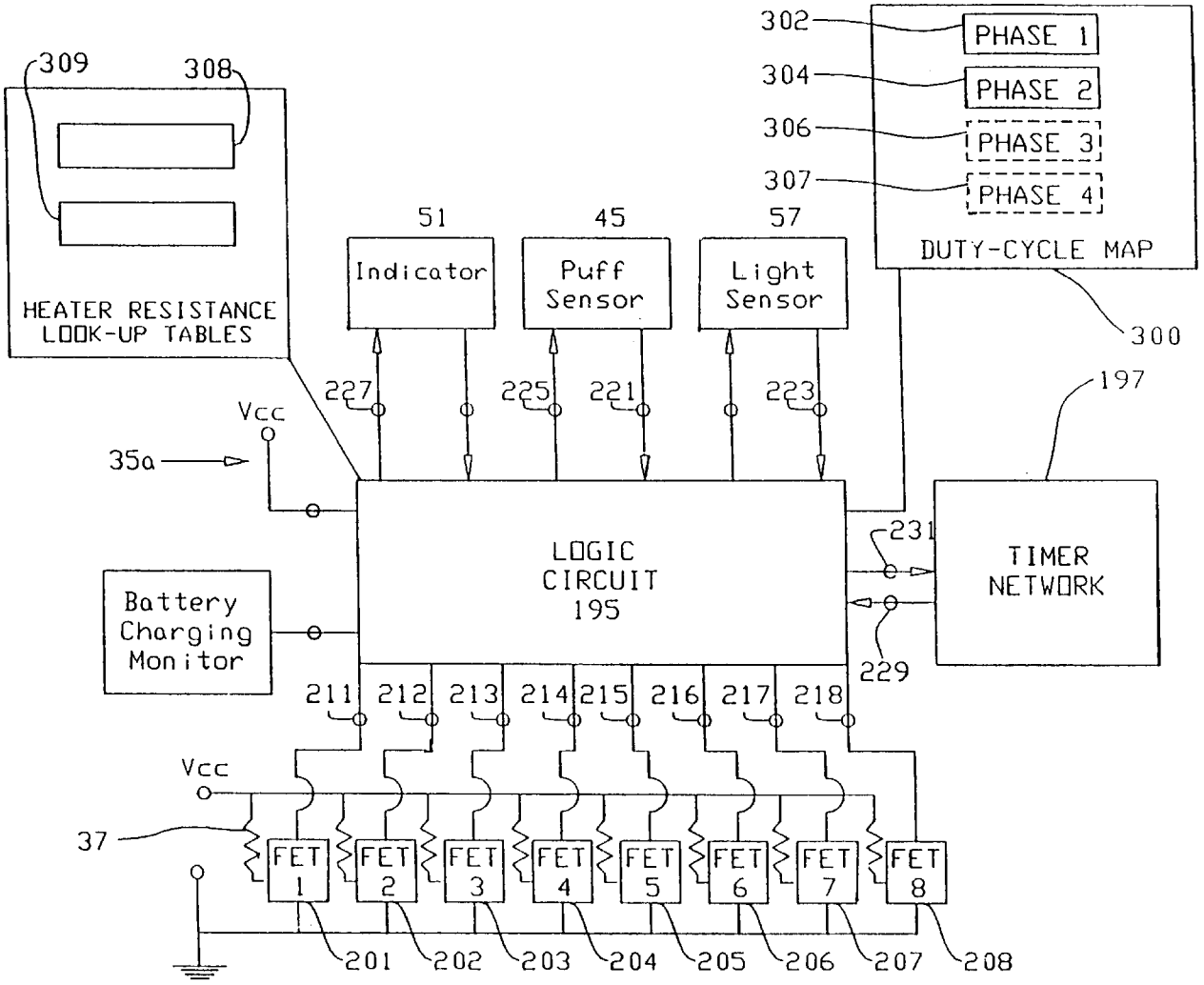
FIG. 5 is a schematic, block-diagram of a preferred control circuit for the lighter shown in FIGS. 1 and 2.

Referring now to FIGS. 2 and 5, the electrical control circuitry 41 of the lighter 25 includes a logic circuit 195, which preferably comprises a micro-controller or an application specific, integrated circuit (or "ASIC"). The control circuitry also includes the cigarette sensor 57 for detecting the insertion of a cigarette 23 in the cigarette receiver 27 of the lighter 25, the puff sensor 45 for detecting a draw upon the inserted cigarette 23, the LCD indicator 51 for indicating the number of puffs remaining on a cigarette, the power source 37 and a timing network 197.

The logic circuit 195 may comprise any conventional circuit capable of implementing the functions discussed herein. A field-programmable gate array (e.g., a type ACTEL A1280A FPGA PQFP 160, available from Actel Corporation, Sunnyvale, Calif.) or a micro controller can be programmed to perform the digital logic functions with analog functions performed by other components. An ASIC or micro-controller can perform both the analog and digital functions in one component. Features of control circuitry and logic circuitry similar to the control circuit 41 and logic circuit 195 of the present invention are disclosed, for example, in commonly assigned, U.S. Pat. Nos. 5,388,594; 5,505,214; 5,591,368; and 5,499,636, all which are hereby incorporated by reference in their entireties. Further details are also provided in the copending, commonly assigned U.S. application Ser. No. 08/755,044 filed Oct. 22, 1996, hereby incorporated by reference in its entirety.

In the preferred embodiment, eight individual heater elements 37 are connected to a positive terminal of the power source 35*a* and to ground through corresponding field effect transistor (FET) heater switches 201–208. Individual (or selected) ones of the heater switches 201–208 will turn on under control of the logic circuit 195 through terminals 211–218, respectively, during execution of a power cycle by the logic circuit 195. The logic circuit 195 provides signals for activating and deactivating particular ones of the heater switches 201–208 to activate and deactivate the corresponding heater element 37 of the heater fixture 39.

The logic circuit 195 cooperates with the timing circuit 197 to precisely execute the activation and deactivation of each heater element 37 in accordance with a predetermined total cycle period ("$T_{total}$") and to precisely divide each total cycle period into a predetermined number of phases, with each phase having its own predetermined period of time ("$t_{phase}$"). In the preferred embodiment, the total cycle period $T^{total}$ has been selected to be 1.6 seconds (so as to be less than the two-second duration normally associated with a smoker's draw upon a cigarette, plus provision for margin) and the total cycle period $T_{total}$ is divided preferably into two phases, a first phase having a predetermined time period ("$t_{phase\ 1}$") of 1.0 seconds and a second phase having a predetermined time period ("$t_{phase\ 2}$") of 0.6 seconds. The total cycle period $T_{total}$, the total number of phases and the respective phase periods are parameters, among others, that are resolved in accordance with the teachings which follow for establishing within the control circuit 41, a capacity to execute a power cycle that precisely duplicates a preferred thermal interaction ("thermal profile" or "thermo-histogram") between the respective heater element 37 and adjacent portions of the cigarette 23. Additionally, once the preferred thermo-histogram is established, certain parameters (preferably, duty cycles within each phase) are adjusted dynamically by the control circuit 41 so as to precisely duplicate the predetermined thermo-histogram with every power cycle throughout the range of voltages $v_{in}$ encompassed by the aforementioned battery discharge cycle.

The puff-actuated sensor 45 supplies a signal to the logic circuit 195 that is indicative of smoker activation (i.e., a continuous drop in pressure or air flow over a sufficiently sustained period of time). The logic circuit 195 includes a debouncing routine for distinguishing between minor air pressure variations and more sustained draws on the cigarette to avoid inadvertent activation of heater elements in response to errant signal from the puff-actuated sensor 45. The puff-actuated sensor 45 may include a piezoresistive pressure sensor or an optical flap sensor that is used to drive an operational amplifier, the output of which is in turn used to supply a logic signal to the logic circuit 195. Puff-actuated sensors suitable for use in connection with the smoking system include a Model 163PC01D35 silicon sensor, manufactured by the MicroSwitch division of Honeywell, Inc., Freeport, Ill., or a type NPH-5-02.5G NOVA sensor, available from Lucas-Nova, Freemont, Calif., or a type SLP004D sensor, available from SenSym Incorporated, Sunnyvale, Calif.

The cigarette sensor 57 is located adjacent the opening 55 of the cigarette receiver 27 and supplies a signal to the logic circuit 195 that is indicative of insertion of a cigarette 23 in the lighter 25 (i.e., a cigarette is within several millimeters of the light sensor, as detected by a reflected light beam). Optionally a second sensor may be located adjacent the stop 183 so as to determine whether the cigarette has been fully inserted into the receiver 27. A light sensor suitable for use in connection with the smoking system is a Type OPR5005 Light Sensor, manufactured by OPTEK Technology, Inc., 1215 West Crosby Road, Carrollton, Tex. 75006.

In the alternative, the cigarette sensor 57 comprises an infrared emitter whose output is directed toward an infrared detector located across the opening 55 from the emitter. As a cigarette 23 is inserted through the opening 55 of the receiver 23, it causes the sensor 57 to register changes in the transmission of the infrared beam across the opening 55, because of the differences in light transmissivity of the tobacco plug 80 and the gap 90 of the cigarette 23. In this fashion the logic circuit is provided a signal from which it can discern between the presence of a gap filler cigarette 27, which smokes well in cooperation with the lighter 25, or some other type of cigarette which might not work as well in the lighter 25.

In order to conserve energy, it is preferred that the puff-actuated sensor 45 and the cigarette sensor 57 be cycled on and off at low duty cycles (e.g., from about a 2 to 10% duty cycle). For example, it is preferred that the puff actuated sensor 45 be turned on for a 1 millisecond duration every 10 milliseconds. If, for example, the puff actuated sensor 45 detects pressure drop or air flow indicative of a draw on a cigarette during four consecutive pulses (i.e., over a 40 millisecond period), the puff actuated sensor sends a signal through a terminal 221 to the logic circuit 195. The logic circuit 195 then sends a signal through an appropriate one of the terminals 211–218 to turn an appropriate one of the FET heater switches 201–208 ON.

Similarly, the cigarette sensor 57 is preferably turned on for a 1 millisecond duration every 10 milliseconds. If, for example, the cigarette sensor 57 detects four consecutive reflected pulses, indicating the presence of a cigarette 23 in the lighter 25, the light sensor sends a signal through terminal 223 to the logic circuit 195. The logic circuit 195 then sends a signal through terminal 225 to the puff-actuated sensor 45 to turn on the puff-actuated sensor. The logic circuit 195 also sends a signal through terminal 227 to the indicator 51 to turn it on. The above-noted modulation techniques reduce the time average current required by the puff actuated sensor 45 and the cigarette sensor 57, and thus extend the life of the power source 37.

The logic circuit 195 includes a PROM (programmable read-only memory) 300, which includes preferably at least two data bases or "look-up tables" 302 and 304, and optionally, a third data base (look-up table) 306 and possibly a fourth look-up table 307. Each of the look-up tables 302, 304 (and optionally 306, 307) converts a signal indicative of battery voltage $v_{in}$ to a signal indicative of the duty cycle ("$dc_1$"for the first phase and "$dc_2$" for the second phase) to be used in execution of the respective phase of the immediate power cycle. Third and fourth look-up tables 306 and 307 function similarly.

Upon initiation of a power cycle, the logic circuit receives a signal indicative of battery voltage $v_{in}$, and then references the immediate reading $v_{in}$ to the first look-up table 302 to establish a duty cycle $dc_1$ for the initiation of the first phase of the power cycle. The first phase is continued until the timing network 197 provides a signal indicating that the predetermined time period of the first phase tphase 1 has elapsed, whereupon the logic circuit 195 references $v_{in}$ and the second look-up table 304 and establishes a duty cycle $dc_2$ for the initiation the second phase. The second phase is continued until the timing network 197 provides a signal indicating that the predetermined time period of the second phase tphase 2 has elapsed, whereupon the timing network 197 provides a shut-off signal to the logic circuit 195 at the terminal 229. Optionally, the logic circuit 195 could initiate a third phase and establish a third duty cycle $dc_3$, and the shut-off signal would not be generated until the predetermined period of the third phase ($t_{phase\ 3}$) had elapsed. A similar regimen could optionally be established with a fourth phase ($t_{phase\ 4}$). The present invention could be practiced with additional phases as well.

Although the present invention can be practiced by limiting reference to the look-up tables to an initial portion of each phase to establish a duty cycle to be applied throughout the substantial entirety of each phase, a refinement and the preferred practice is to have the logic circuit 195 configured to continuously reference $v_{in}$ together with the respective look-up tables 302, 303, 306 and 307 so as to dynamically adjust the values set for duty cycles in response to fluctuations in battery voltage as the control circuit progresses through each phase. Such device provides a more precise repetition of the desired thermo-histogram.

Other timing network circuit configurations and logic circuits may also be used, such as those described in the commonly assigned, U.S. Pat. Nos. 5,388,594; 5,505,214; 5,591,368; 5,499,636; and 5,372,148, all which are hereby incorporated by reference in their entireties.

During operation, a cigarette 23 is inserted in the lighter 25 and the presence of the cigarette is detected by the cigarette sensor 57. The cigarette sensor 57 sends a signal to the logic circuit 195 through terminal 223. The logic circuit 195 ascertains whether the power source 35*a* is charged or whether the immediate voltage is below an acceptable minimum $v_{in\ min.}$If, after insertion of a cigarette 23 in the lighter 25, the logic circuit 195 detects that the voltage of the power source 35*a* is too low, below $v_{in\ min,}$ the indicator 51 blinks and further operation of the lighter will be blocked until the power source 35*a* is recharged or replaced. Voltage of the power source 35*a* is also monitored during firing of the heater elements 37 and the firing of the heater elements 37 is interrupted if the voltage drops below a predetermined value.

If the power source 35*a* is charged and voltage is sufficient, the logic circuit 195 sends a signal through terminal 225 to the puff sensor 45 to determine whether a smoker is drawing on the cigarette 23. At the same time, the logic circuit 195 sends a signal through the terminal 227 to the indicator 51 so that the LCD will display the digit "8", reflecting that eight puffs are available.

When the logic circuit 195 receives a signal through terminal 221 from the puff-actuated sensor 45 that a sustained pressure drop or air flow has been detected, the logic circuit 195 sends a signal through terminal 231 to the timer network 197 to activate the timer network, which then begins to function phase by phase in the manner previously described. The logic circuit 195 also determines, by a downcount routine, which one of the eight heater elements is due to be heated and sends a signal through an appropriate terminal 211–218 to turn an appropriate one of the FET heater switches 201–208 ON. The appropriate heater stays on while the timer runs.

When the timing network 197 sends a signal through terminal 229 to the logic circuit 195 indicating that the timer has stopped running, the particular ON FET heater switch 211–218 is turned OFF, thereby removing power from the particular heater element 37. The logic circuit 195 also downcounts and sends a signal to the indicator 51 through terminal 227 so that the indicator will display that one less puff is remaining (e,g., "7", after the first puff). When the smoker next puffs on the cigarette 23, the logic circuit 195 will turn ON another predetermined one of the FET heater switches 211–218, thereby supplying power to another predetermined one of the heater elements. The process will be repeated until the indicator 51 displays "0", meaning that there are no more puffs remaining on the cigarette 23. When the cigarette 23 is removed from the lighter 25, the cigarette sensor 57 indicates that a cigarette is not present, and the logic circuit 195 is reset.

Other features, such as those described in U.S. Pat. No. 5,505,214; 5,388,594; and 5,372,148 which are incorporated by reference, may be incorporated in the control circuitry 41 instead of or in addition to the features described above. For example, if desired, various disabling features may be provided. One type of disabling feature includes timing circuitry (not shown) to prevent successive puffs from occurring too close together, so that the power source 35*a* has time to recover. Another disabling feature includes means for disabling the heater elements 43 if an unauthorized product is inserted in the heater fixture 39. For example, the cigarette 23 might be provided with an identifying characteristic that the lighter 25 must recognize before the heating elements 37 are energized.

Figure 6:
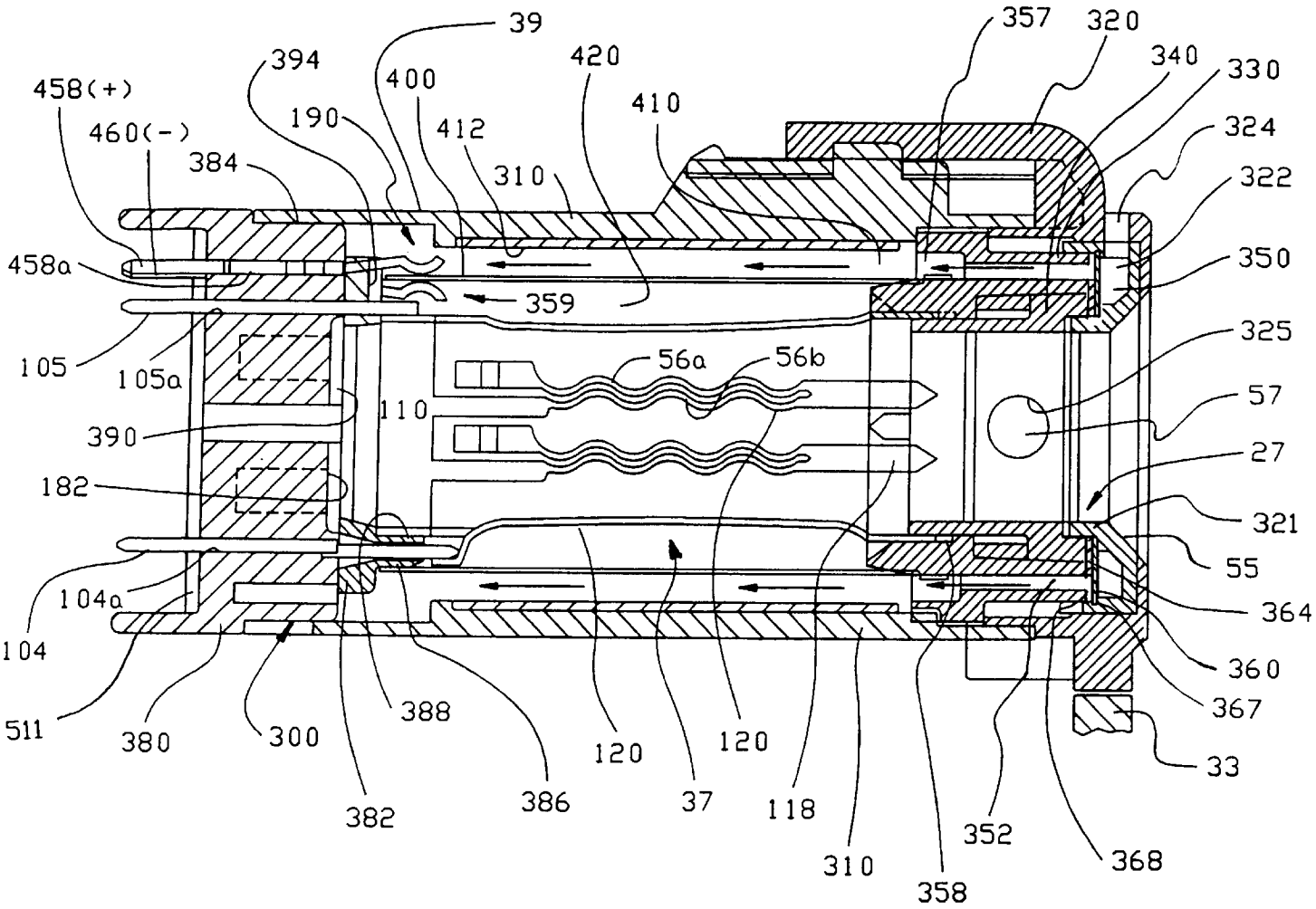
FIG. 6 is a sectional side view of a preferred heater fixture which includes the wavy hairpin heater elements of FIG. 3A.

Referring now to FIG. 6, the heater fixture 39 preferably comprises a base portion 300, a generally cylindrical case sleeve 310 extending co-axially from the base portion 300 and a case cap 320 at the opposite end of the case sleeve 310 from the base portion 300.

A portion of the case cap 320 and exposed portions of a cap piece 321 provide surfaces defining the opening 55 of the cigarette receiver 27. An annular recess 322 is formed about an interior portion of the cap piece 321. Preferably, the recess 322 is situated concentrically about the opening 55. A porting ring 330 and a second sealing ring 340 are positioned co-axially with the cap piece 321 and adjacent the recess 322 of the case cap 320 so that the cap piece 321 and adjacent portions of the porting and sealing rings 330, 340 define a manifold 350. Air is drawn into the manifold 350 through a drawing port 324 which extends through an adjacent portion of the case cap 320 and cap piece 321. The sealing ring 340 and the porting ring 330 are mutually engaged, preferably by snap-fit or by threading, with the porting ring 330 being disposed about the sealing ring 340. The cap piece 321 is fitted, preferably threaded, into at least one of the rings 330, 340.

A transverse aperture 325 extends through the porting and sealing rings 330, 340 for placement of the cigarette detector 57.

Figure 7A:
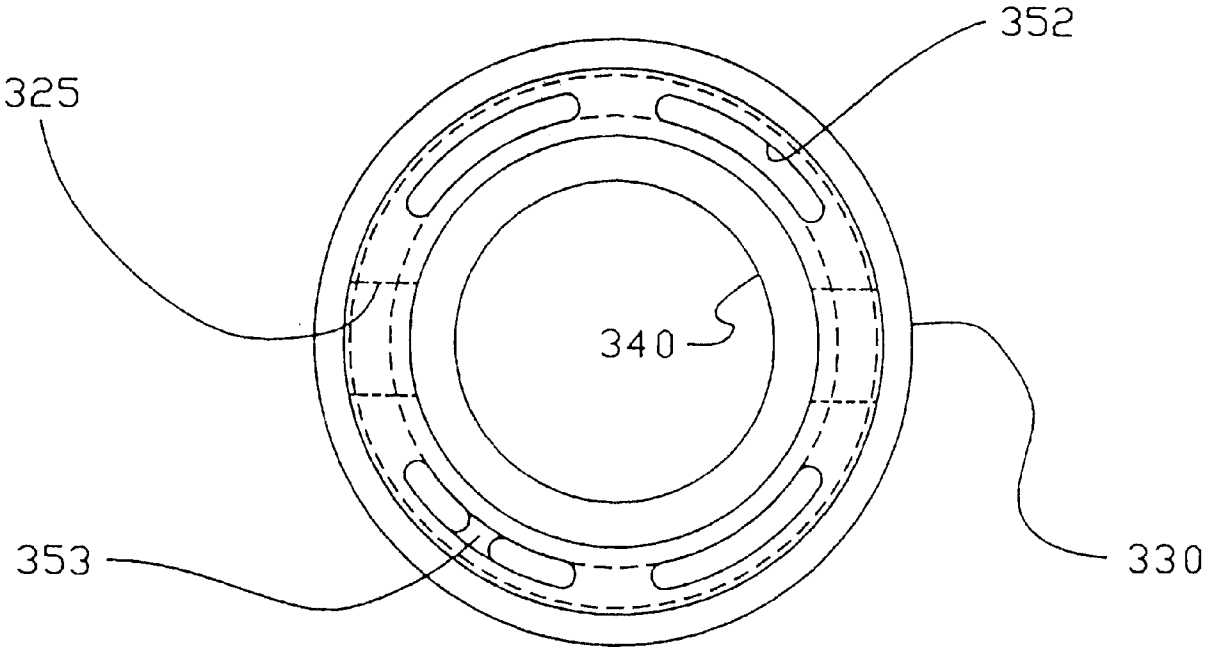
FIG. 7A is an end planar view of the porting ring of the cap assembly shown in FIG. 6.

Referring now also to FIG. 7A, a plurality of circumferentially elongate ports 352 are formed in the porting ring 330. The ports 352 extend axially in a direction toward the base portion 300 of the heater fixture 39. The ports 352 of the parting ring 330 are each preferably elongate in the circumferential direction and may optionally include a rib 353 to provide rigidity and/or further divide air flow as it passes through the porting ring 330. The ports 352 are shaped so as to spread airflow circumferentially as it is being drawn toward the base portion 300 of the heater fixture 39. In the preferred embodiment, the ports 352 discharge through an annular manifold 357 formed in the downstream portion of the porting ring 330. However, practice of the present invention may be achieved without the manifold 357, and the ports 352 may be provided with various other shapes and sizes to achieve the desired flow distribution and direction as is achieved with the porting ring 330 of the preferred embodiment.

At a location intermediate of the ports 352 and the manifold 350 is situated a planar, annular frit 360 such that any air drawn into the manifold 350 through the drawing port 324 must past through the frit 360 before entering the ports 352 of the porting ring 330. Preferably, the outer perimeter of the frit 360 is received in an annular groove 367 in the cap piece 321, while an inner annular edge portion of the frit 360 is received between opposing annular portions of the cap piece 321 and the porting and sealing rings 330, 340, preferably the latter, with an annular spacer 364 interposed between the opposing portions of the inner ring 340 and the frit 360. By such arrangement, a radially intermediate, annular portion of the frit 360 is disposed across the annular recess 322 of the cap piece 321, such that the frit 360 determines the relationship between the rate at which air may be drawn from the manifold 350 and the corresponding pressure drop (or resistance to draw).

To minimize warping of the frit 360, the annular spacer 364 is preferably configured to prevent contact between edges of the ports 352 and adjacent portions of the frit 360 so that a precisely controlled amount of the frit 360 is operatively interposed across the manifold 350. Such arrangement provides a more precise placement of per unit area of frit 360 so that flow rate and resistance to draw can be precisely matched from lighter to lighter. Although practice of the invention could be undertaken without the spacer 364, in its absence, contact between the edges of the ports 352 and the frit 360 would tend to warp adjacent portions of the frit 360 and affect flow rate and pressure drop. Accordingly, the spacer promotes uniformity from lighter to lighter.

Additionally, the spacer 364 establishes an annular space 368 between the frit 360 and the inlets of the ports 352. Not wishing to be bound by theory, it is believed that the annular space 368 acts like a manifold for the air drawn through the frit 360 so that the flow rate and pressure drop across the frit is not determined by the size of the ports 352, but instead is determined by the characteristics of the frit 360, such as its the mesh size, physical make-up and dimensions.

The above described arrangement is advantageous in that it controls resistance-to-draw and total flow rate with a first element (the frit 360), which itself is precise and easily reproducible, and controls dispersement and direction of the air flow with a second element (the porting ring 330). The functionalities of the two elements are substantially decoupled from one another by the imposition of an annular space 368 between the two elements as established by the spacer 364, which spaces the frit 360 apart from the ports 352 of the porting ring 330. Advantageously, the total airflow drawn into the smoking system 22 is not determined by the size of ports 352, but instead by the relatively large annular area of the frit 360.

Preferably, the frit 360 comprise a planar annulus of fine wire cloth that is commercially available from sources such as the Newark Wire Cloth Company of Newark, N.J. In the preferred embodiment, the wire cloth is preferably constructed as follows:

| | |
|---|---|
| Mesh (count per inch) | 250 × 1400 strands |
| Wire | 0.0022 dia for 250 strands/ 0.0016 dia for 1400 strands |
| Material | Stainless 304 |
| Absolute filter rating (microns) | 11 to 12 |
| Nominal filter rating (microns) | 3 to 4. |

Figure 7B:
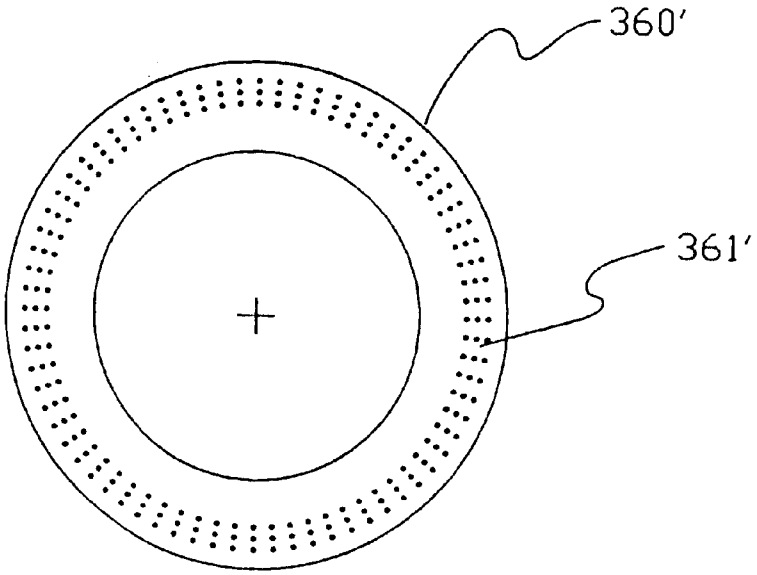
FIG. 7B is a planar view of an alternate embodiment of a frit in accordance with the present invention.

Referring now to FIG. 7B, the frit 360 may be constructed from other materials such as from a paper disk 360' having a perforated annular region 361' which achieves the desired resistance-to-draw at the desired total flow rate. Other possible materials and constructions include porous metals, porous or perforated plastics, woven and non-woven mats, compacted tow and other forms of cellulose acetate. Any air porous materials which are configured to provide the airflow characteristics described herein may be used in lieu of or in conjunction with the specific materials described in the preferred embodiments. The term "frit" as used herein is intended to encompass all such constructions and materials.

Figure 8:
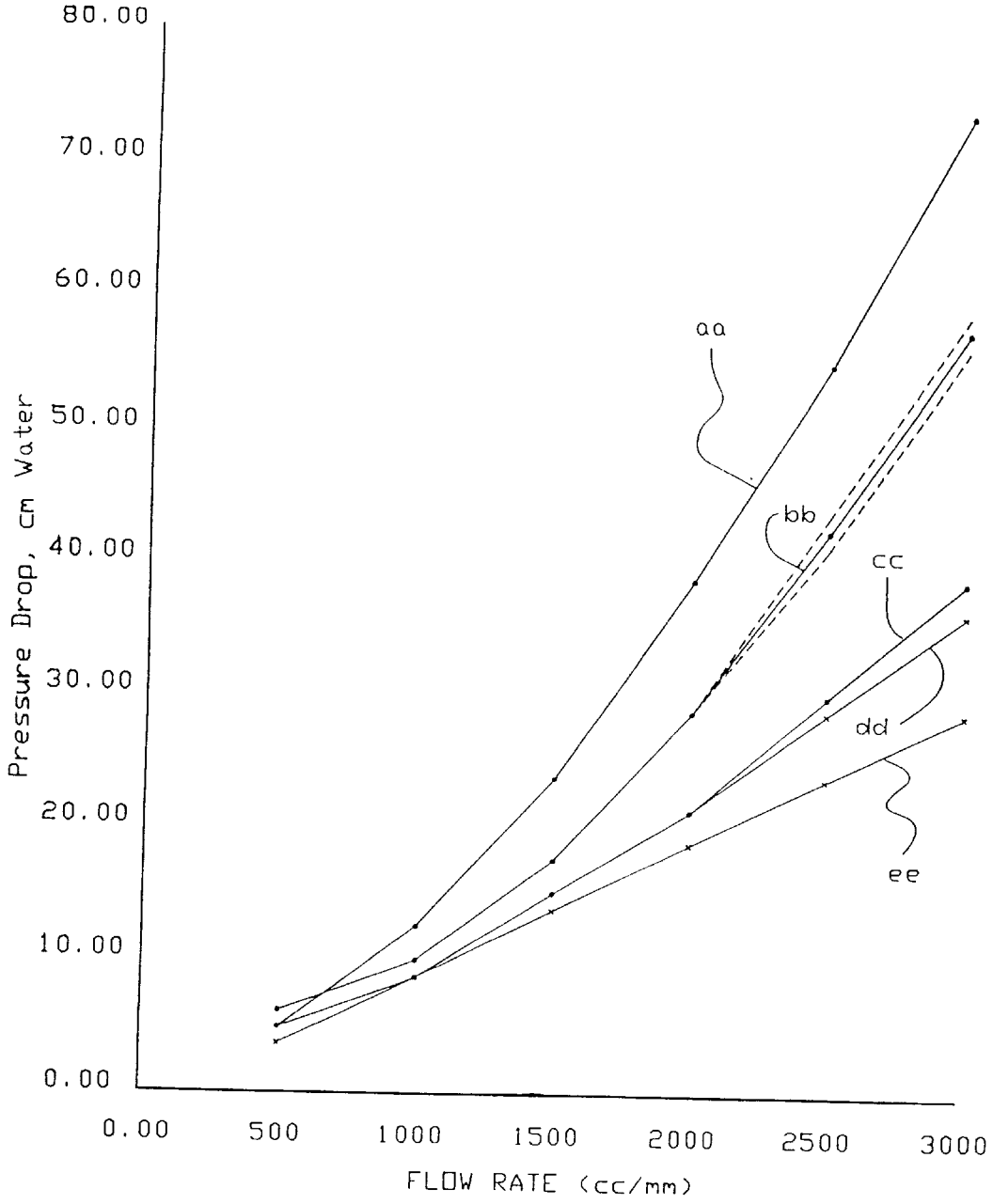
FIG. 8 is a graphical representation of the dynamic responses of traditional filter cigarettes in comparison to air management systems of prior electric lighters and those constructed in accordance with preferred embodiments of the present invention.

Referring now to FIG. 8, the materials, geometry and other physical attributes of the frit 360 are selected such that the frit renders a desired resistance to draw ("RTD") at a predetermined flow rate. Preferably, the frit 360 is constructed to produce an RTD in the range of approximately 70 to 100 mm of water, more preferably, in the range of approximately 80 to 115 mm of water at a desired flow rate. For example, one might preferably select an RTD of approximately 100 mm water at a sustained draw rate of 1050 cc/min. Other design points may be used instead. Preferably, the RTD of the frit 360 will increase as flow rate increases in a manner similar to how changes in draw rate increases the RTD of traditional filter tip cigarettes.

For example, in FIG. 8, the line designated ee shows the relationship between pressure drop and variation in flow rate of a traditional filter tip cigarette. Lines aa and bb show the relationship between pressure drop and flow rate for an electrical smoking system of the prior type disclosed in the commonly assigned U.S. Pat. No. 5,388,594 and having a ported airflow intake lacking a frit arrangement of the present invention. As flow rate increases, lines aa and bb diverge increasingly away from line ee.

Still referring to FIG. 8, lines cc and dd show the relationship between pressure drop and flow rate for an electrical smoking article constructed in accordance with preferred embodiments of the present invention. Line cc corresponds to results obtained with a metal frit disc while line dd corresponds to a perforated paper frit disc. Both lines cc and dd lie more closely to line ee of the traditional filter tip cigarette than do lines aa and bb of the prior electrical smoking systems. The present invention provides an RTD response more closely resembling that which is experienced with a traditional filter tip cigarette.

Figure 9:
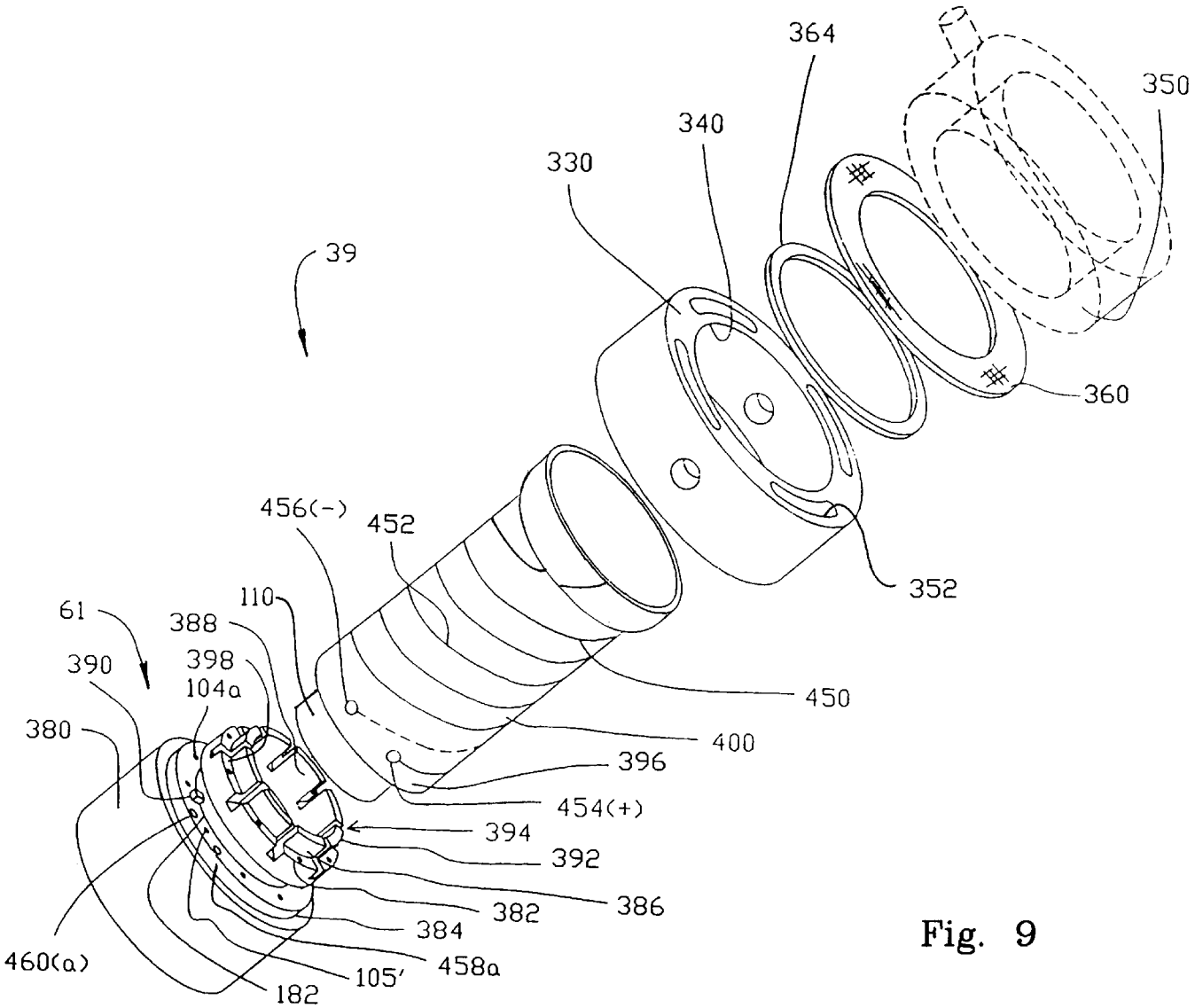
FIG. 9 is an exploded, side perspective view of portions of the heater fixture shown in FIG. 6.

Referring now to FIGS. 6 and 9, the base portion 300 of the heater 39 preferably comprises a terminal base piece 380 and a terminal ring 382, both which include surfaces, notches, grooves and holes for placement and spacing of structural components, electrical elements and air channels.

In particular, the terminal base piece 380 includes an outer annular groove 384 for receipt of one end portion of the case sleeve 310 (not shown for sake of clarity in FIG. 9). Region 386 of the terminal ring 382 is adapted to receive an end portion 396 of the secondary, heater element (cleaner can) 400 whereas an inner surface 388 of the terminal ring 382 is configured to receive the common connection ring 110 of the heater elements 37, preferably such that the case sleeve 310, the cleaner can 400 and the heater elements 37 are mutually concentric. A hole 105*a* in the terminal base piece 380 is provided for the pin 105 for electrical connection of the common ring 110 with either the positive terminal of the power source 35*a*. Likewise a plurality of holes 104*a* is provided for the placement of pins 104 for effecting an electrical connection between the elongate member 56*a* of each heater blade 120 with one of the field effect transistor (FET) heater switches 201–208.

A radially directed, bypass channel 390 is formed in the face of the terminal base piece 380 to provide an supplemental air channeling during the first puff on the cigarette 23. The bypass channel 390 initiates at a location on the terminal base piece 380 that is radially outside of the terminal ring 382 and extends radially into the region of stop 182 where the free end of the cigarette 23 abuts the central face portion of the terminal base piece 380.

The terminal ring 382 includes an annular portion 392 that locates between the cleaner can 400 and the connection ring 110 of the heater elements 37. A plurality of circumferentially spaced air passages in the form of notches 394 are located in the annular portion 392. In the preferred embodiment, an end portion 396 of the cleaner can 400 abuts an outer rim 398 adjacent the notches 394 such that the notches 394 provide air passages about the end portion 396 of the cleaner can 400.

The porting ring 330 also includes surfaces for receiving the opposite end portion of the cleaner can 400.

When joined, the porting ring 330 and the sealing ring 340 define an annular grove 358 which receives the tips 118 of the heater blades 120.

Preferably, by such arrangement, the cigarette receiver 27, the porting and sealing rings 330 and 340, the heater elements 37 and the cleaning element 400 are all secured, preferably in a concentric relation to each other and to the case sleeve 310. The resultant arrangement is such that an outer annular passageway 410 is defined between the case sleeve 310 and the cleaner can 400, and an inner annular passageway 420 is defined between the cleaner can 400 and the heater elements 37. The outer annular passage 410 is communicated with the inner annular passageway 420 through each of the notches 394 in the annulus 392 of the terminal ring 382 as previously described.

Preferably, a heat reflector 412 is provided along a portion of the case sleeve 310 adjacent the cleaner can 400.

Now referring to FIGS. 6 and 9, the cleaner can 400 comprises a cylindrical, preferably swaged, sleeve 450 and an electrically resistive, helical winding 452 disposed along the sleeve 450. Preferably, the winding 450 originates at a positive terminal 452 on one side of the sleeve 450 and terminates on an opposite side of the sleeve 450 at a negative terminal 456. The positive terminal 452 is connectable to a source of power through a positive terminal pin 458 which extends through a hole 458*a* provided in the base portion 300 of the heater fixture 39. Likewise the negative terminal 456 is connectable to the negative terminal and control logic of a power source and/or ground through a negative terminal pin 460 which extends through a hole 460*a* provided in the base portion 300 of the heater fixture 39.

The cleaner can 400 is operative for the execution of a cleaning cycle of the heater fixture 39, wherein electrical power is supplied to the winding 452 to heat the sleeve 450, which in turn heats via convection and/or radiation various other components of the heater fixture 39, particularly the surfaces the heater blades 120 to thermally liberate condensates deposited thereon during a cleaning cycle.

Alternatively, sleeve 450 is heated during a cleaning cycle by the heater elements 37, or by a separate heater device which is brought into thermal proximity with the sleeve 450 during a combined cleaning and recharging operation.

The cylindrical sleeve 450 can define any geometrical shape that comprises a surface for condensing, collecting and/or accumulating at least some of the aerosols not delivered to a smoker and preferably comprises a material which forms a suitable aerosol barrier between the inserted cigarette and other components, in particular relatively outer sleeve 84. A ceramic, e.g, alumina, e.g., an approximately 94% alumina commercially available from Kyocera America, Co. of San Diego, Calif. or Coors Technical Ceramics Co. of Oak Ridge, Tenn., or metal, e.g., Haynes® Alloy No. 214, a nickel-based alloy containing 16.0 percent chromium, 3.0 percent iron, 4.5 percent aluminum, traces of yttrium and the remainder (approximately 75 percent) being understood to be nickel, commercially available from Haynes International of Kokomo, Ind., preferably coated with a ceramic encapsulating and insulting coating, can be employed for sleeve 450. Various stainless steel alloys are suitable for the construction of the cleaner can 400.

In addition, the material of heater sleeve 450 should be durable and able to withstand the heating cycle described below for an acceptable period, e.g., the life of the electrical lighter, e.g., approximately 6 to 18 months. The sleeve 450 may be contoured to match the inner bowing of the blades 120.

Alternatively, the cleaner can 400 may be constructed as a metal sleeve laminate similar to the heater constructions set forth in commonly assigned U.S. Ser. No. 08/370,125, filed Jan. 9, 1995, which is hereby incorporated by reference in its entirety. Further alternative constructions are set forth in commonly assigned U.S. Ser. No. 08/756,223, filed Nov. 25, 1996.

The heating element 452 is preferably in intimate thermal contact with the cylindrical sleeve 200. Alternatively, sleeve 450 is itself electrically resistive, e.g., a metal which is directly, resistively heated. The heating element 452 may comprise wire or wires in a host of other configurations along either or both sides of the sleeve 450. For example, the heating element 452 might comprise a plurality of axially oriented, linear elements or mutually parallel linear elements that are skewed relative to the axis of symmetry of the can 400.

Preferably, the turns of the winding 452 are insulated from one another so as to prevent short circuits. For example, the resistive winding 452 can be cradled in at least one helical groove formed along one or more of the surfaces of the sleeve 450 so as to assure adequate separation of the turns.

Figure 10:
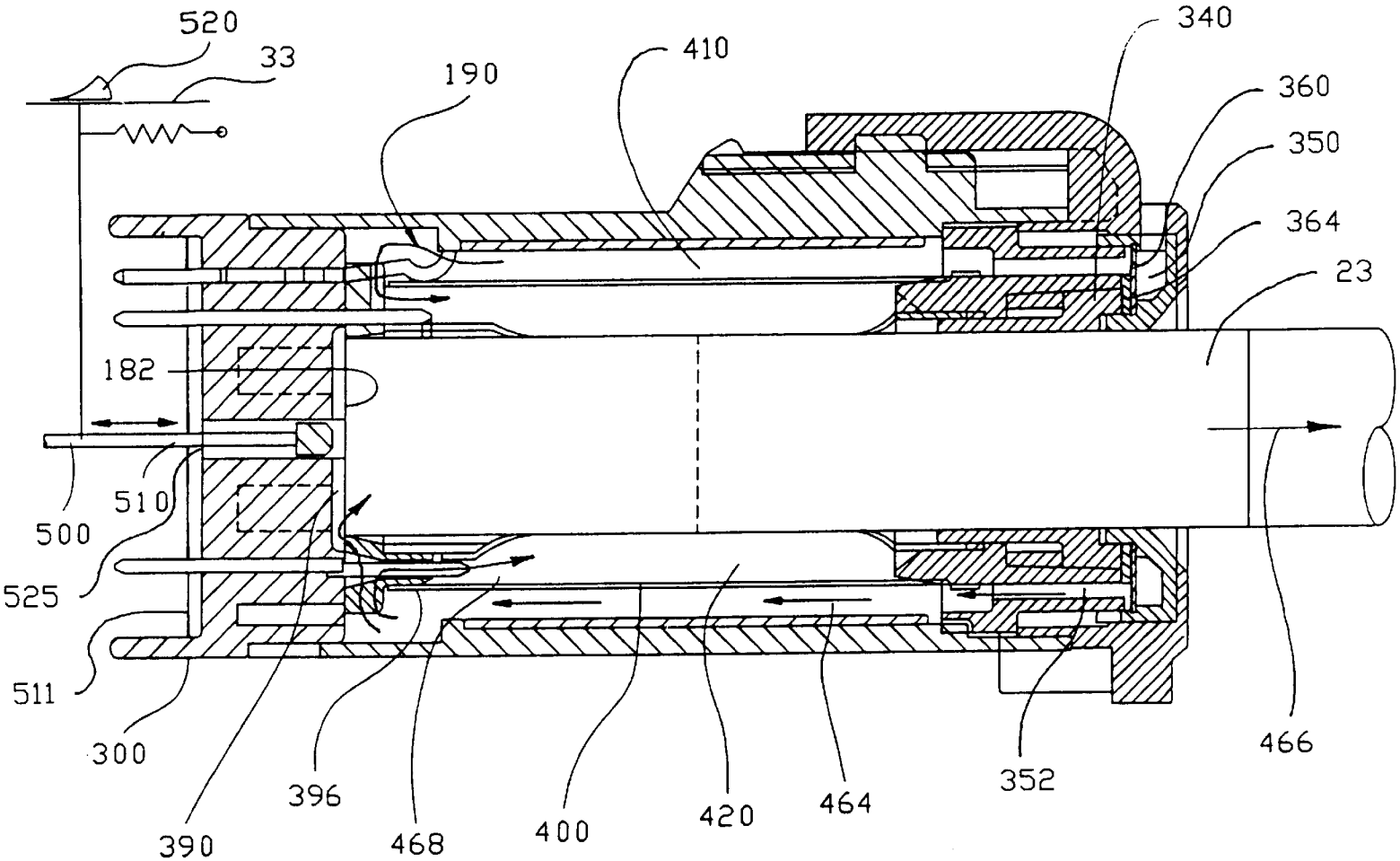
FIG. 10 is a side view of the cigarette shown in FIG. 4 inserted into the heater fixture of FIG. 6, with the latter being shown in cross-section.

Referring now to FIG. 10, upon a smoker's draw upon a cigarette 23 during a smoke, air is drawn from the manifold 350, through the frit 360 and the ports 352 of the sealing ring 340 and along the outer annular passageway 410. At that point, the air is being drawn in a direction (as generally indicated by the arrow 464 in FIG. 10) which is generally opposite (countercurrent) of the general direction that smoke is drawn from the cigarette by the smoker (as generally indicated by the arrow 466 in FIG. 10). As previously described, after the air is drawn along the outer annular passage 410, it is drawn about the end portion 396 of the secondary heater element (cleaner can) 400 through the notches 394 provided in the base portion 300 to enter the inner annular passageway 420. This turning of the air about the end portion 396 establishes a direction in the airflow (as generally indicated by the arrow 468 in FIG. 10) which is generally concurrent with the direction 466 at which smoke is withdrawn from the cigarette 23 by the smoker. The heater fixture turns the air at a location (about the end portion 396 of the can 400) which is upstream of and spaced from the locus where tobacco aerosol is being created at the active heater element 37, so that less turbulence occurs at the heating locus and less unwanted dispersion of tobacco aerosol occurs at or about the heater elements 120. Unevacuated tobacco aerosol can create condensates about the internal workings of the lighter.

As previously discussed, the airflow management system of the present invention further includes the promotion of a uniform circumferential distribution of air as it is drawn through the ports 352 of the porting ring 330 and along the outer annular passage 420 to the end portion 396 of the cleaner can 400. Such arrangement promotes uniformity amongst the operations of the individual heater elements. Again also, the placement of a frit 360 at a location upstream of the porting ring facilitates precise, reproducible determination of total flow rate and resistance-to-draw characteristics in the smoking system 21. All these attributes, singularly and in concert, contribute to an enhancement of smoking pleasure.

Usually, air is drawn transversely into the cigarette 23 from the inner annular passageway 420 through breaks in the wrapper 71 and tobacco web 66 caused by the charring from the immediate or preceding puff cycles. However, for the first puff on a cigarette 23, such breaches will not have not been established. In order to minimize differences between the first puff and others, an alternate air passageway is provided by the bypass channel 390 which directs the air instead from the outer annular passage 410 to the free end portion of the cigarette 21 that is abutting the stop 182. As the first puff progresses and for subsequent puffs, once the cigarette wrapper 71 and tobacco web 66 are breached, such breach short circuits the air flow path defined by the bypass channel 390 and the flow characteristically follows the previously described flow pattern.

The frit 360 provides a capacity to control the relationship of flow rate and resistance to draw. The physical extent of the frit 360 over a relatively large annular surface is such that minor variations in the structure of the frit 360 do not dramatically affect that relationship. The frit also eliminates whistling that arises when air is caused to pass through tiny cylindrical channels of the prior art. The arrangement also permits one to shape and size the ports 352 of the porting ring 330 to a configuration most favorable for the even distribution and direction of air without constraints regarding total air flow and pressure drop, the latter factors being controlled separately by the frit 360.

If desired, the helical winding 452 of the cleaner can 400 and its associated grooves may be constructed such that they create one or more minute air passages in the region where the cleaner can 400 abuts the porting ring 330 so that a small, predetermined fraction of air may drawn more directly to the cigarette.

Still referring to FIG. 10, the heater fixture 39 preferably includes a cigarette ejector system 500 preferably comprising an axially movable plunger 510 for urging the inserted end of a cigarette 23 away from the base portion 300 and at least partially out of the cigarette receiver 27 at the conclusion of a smoking. Preferably, the plunger is movable between a retracted position at the base portion 300 of the heater fixture 39 (shown in FIG. 10) and its fully extended position adjacent the sealing ring 340 by manual operation of a spring biased slider 520 located along side the front housing portion 33. Further details concerning the ejector system 500 are set forth in copending, commonly assigned U.S. Pat. No. 5,726,421 which is hereby incorporated by reference in its entirety.

Preferably, the ejector system 500 includes a seal 511 in the form of a thin gasket of flexible material on the backside of the base portion 300. The seal 511 prevents extraneous material including tobacco from escaping the heater fixture 39 through the various holes and ports of the base portion 300, particularly at or about the locus 525 adjacent the plunger 510.

The above-described embodiments are to be regarded as illustrative rather than restrictive, and it should be appreciated that variations, changes and equivalents may be made by others without departing from the scope of the present invention as defined by the following claims. For example, although the preferred cigarette design is the layout of the gap-filler cigarette 23, other cigarette designs might be utilized instead. As mentioned previously, heater elements of various alternate geometries may be employed in the heater fixture 39. Practices in accordance with the present invention provide significant advantages in the operation of electrical smoking systems.

What is claimed is:

1. A method of establishing resistance to draw upon a cigarette while smoking a cigarette in an electrical smoking system, said method comprising the step of operatively interposing a frit between a source of ambient air and the cigarette.

2. A method of operating an electrical smoking system, said method comprising the steps of:

inserting a cigarette into a cigarette receiver of an electrical lighter so that an operative portion of a heater fixture of said lighter is located adjacent a portion of said cigarette; and executing a puff cycle responsively to a drawing action upon the cigarette by actuating said operative portion of said heater fixture while communicating air to a region within said lighter adjacent said operative portion of said heater fixture, said communicating step including the step of drawing air through an air permeable body upstream of said region during said puff cycle.

3. The method as claimed in claim 2 wherein said air permeable body is a frit.

4. The method as claimed in claim 3 further comprising the step of distributing the air circumferentially about said cigarette before said step of drawing air through said frit.

5. The method as claimed in claim 4 further comprising the steps of:

first drawing the air within the lighter in a first direction toward an inserted end of said cigarette; and turning the air so that the air is further drawn in a second, countercurrent direction toward said region adjacent said operative portion of said heater fixture.

6. The method as claimed in claim 5 further comprising the step of directing air to said inserted tip during at least a portion of a first puff cycle of a predetermined sequence of puff cycles.

7. An apparatus establishing flow rate and resistance to draw during smoking of a cigarette in an electrical smoking system, said apparatus comprising a frit at a location along an air passageway extending between a source of ambient air and the cigarette.

8. A lighter of an electrical smoking system comprising:

a cigarette receiver including a heater element operative at a first location along said cigarette receiver;

a passageway communicating a source of air with said location along said cigarette receiver so that upon drawing action upon a cigarette received in said cigarette receiver, air is drawn along said passageway to said cigarette; and a frit at a location along said passageway.

9. A lighter of an electrical smoking system, said lighter comprising:

a cigarette receiver comprising a base portion, an open end portion and a heater fixture, said open end portion and said heater fixture adapted to slidingly receive a cigarette;

an air admission port for admitting air into said lighter;

a passageway communicating said air admission port with a location along said cigarette receiver adjacent heater fixture; and a frit at a location along said passageway.

10. The lighter as claimed in claim 9, wherein said passageway includes an annular manifold concentric to said cigarette receiver, said annular manifold in communication with said air admission port and located upstream of said frit such that as air is drawn into the lighter, air is distributed circumferentially about said manifold before passing through said frit.

11. The lighter as claimed in claim 10, wherein said frit includes an annular portion adjacent said manifold such that air being drawn from said manifold passes through said annular portion of said frit.

12. The lighter as claimed in claim 11, wherein said open end portion includes a cigarette receiving opening and said manifold is concentric and adjacent to said cigarette receiving opening.

13. The lighter as claimed in claim 11, wherein said passageway includes a porting ring downstream of said frit, said porting ring including a ring port arranged to direct air in a first direction toward said base portion.

14. The lighter as claimed in claim 13, wherein said frit is spaced apart from said porting ring.

15. The lighter as claimed in claim 14, wherein said frit is spaced apart from said ring port sufficiently to define a second manifold operatively disposed between said frit and said porting ring.

16. The lighter as claimed in claim 14, wherein said porting ring includes a plurality of said ring ports, said ring ports being circumferentially elongate in cross-section.

17. The lighter as claimed in claim 14 wherein said passageway further comprises:

a radially outer, generally annular passage portion downstream of said porting ring for further directing air in said first direction toward said base portion;

a second radially inner, generally annular passage portion downstream of said first radially outer passage portion, said second radially inner passage portion directing air in a second direction toward said heater fixture, said second direction being generally countercurrent with respect to said first direction; and an arrangement adjacent said base portion for passing air from said first radially outer passage portion into said second radially inner passage portion.

18. The lighter as claimed in claim 17, wherein said passing arrangement comprises a plurality of openings circumferentially disposed about said base portion, said turning arrangement being downstream of an electrically operative portion of said heater fixture.

19. The lighter as claimed in claim 14 wherein said heater fixture comprises a plurality of heater elements arranged in a mutually parallel, substantially cylindrical array;

said lighter further comprising a substantially cylindrical body concentrically disposed about said substantially cylindrical array of heater elements, said substantially cylindrical body at least partially defining a radially outer portion of said passageway, said radially outer portion of said passageway located downstream of said porting ring and further directing air in said first direction toward said base portion;

said passageway further comprising a radially inner passage portion at least partially defined between said substantially cylindrical body and said substantially cylindrical array of heater elements, said radially inner passage portion downstream of said radially outer passage portion;

said passageway further comprising an opening adjacent said base portion for turning air toward a second countercurrent direction from said first direction as air is drawn from said radially outer passage portion into said inner passage portion.

20. The lighter as claimed in claim 19, wherein said opening adjacent said base portion for turning air comprises a plurality of openings circumferentially disposed about said base portion and adjacent an end portion of said substantially cylindrical body.

21. The lighter as claimed in claim 20, wherein said base portion includes a cigarette stop adapted to receive a free end of a cigarette and a radially directed channel for passing air from said radially outer portion of said lighter to a cigarette receiving portion of said stop, said radial channel further removed from an electrically operative portion of said heater fixture than said air turning opening.

22. The lighter as claimed in claim 21, wherein said substantially cylindrical body comprises a secondary heater operable during a cleaning cycle of the lighter.

23. The lighter as claimed in claim 7, 8 or 14, wherein said frit comprises a screen.

24. The lighter as claimed in claim 7, 8 or 14, wherein said frit comprises a metallic, twill weave screen.

25. The lighter as claimed in claim 7, 8 or 14, wherein said frit comprises an air permeable, fibrous body.

26. The lighter as claimed in claim 7, 8 or 14, wherein said frit comprises an air permeable metallic body.

27. The lighter as claimed in claim 7, 8 or 14, wherein said frit comprises a perforated paper.

28. The lighter as claimed in claim 9 or 21 further comprising a ejector system adapted to urge a cigarette away from said base portion; and a gasket located at a backside of said base portion, said gasket providing a seal with said a movable portion of said ejector system.

29. The method as claimed in claim 1 or 3, wherein said frit comprises a screen.

30. The method as claimed in claim 1 or 3, wherein said frit comprises a metallic, twill weave screen.

31. The method as claimed in claim 1 or 3, wherein said frit comprises an air permeable, fibrous body.

32. The method as claimed in claim 1 or 3, wherein said frit comprises an air permeable metallic body.

33. The method as claimed in claim 1 or 3, wherein said frit comprises a perforated paper.

* * * * *